US007855039B2

(12) United States Patent
Wu et al.

(10) Patent No.: US 7,855,039 B2
(45) **Date of Patent: *Dec. 21, 2010**

(54) PHOTOCONDUCTORS CONTAINING KETAL OVERCOATS

(75) Inventors: Jin Wu, Webster, NY (US); John F. Yanus, Webster, NY (US); Kenny-Tuan Dinh, Webster, NY (US); Kent J Evans, Lima, NY (US)

(73) Assignee: Xerox Corporation, Norwalk, CT (US)

( * ) Notice: Subject to any disclaimer, the term of this patent is extended or adjusted under 35 U.S.C. 154(b) by 421 days.

This patent is subject to a terminal disclaimer.

(21) Appl. No.: 11/961,549

(22) Filed: Dec. 20, 2007

(65) Prior Publication Data

US 2009/0162766 A1 Jun. 25, 2009

(51) Int. Cl.
*G03G 5/00* (2006.01)

(52) U.S. Cl. ..... 430/66; 430/58.8

(58) Field of Classification Search ..... 430/58.8, 430/66

See application file for complete search history.

(56) References Cited

U.S. PATENT DOCUMENTS

| | | | | |
|---|---|---|---|---|
| 4,265,990 | A | 5/1981 | Stolka et al. | |
| 4,587,189 | A | 5/1986 | Hor et al. | |
| 4,921,769 | A | 5/1990 | Yuh et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,913,863 | B2 | 7/2005 | Wu et al. | |
| 7,037,631 | B2 | 5/2006 | Wu et al. | |
| 7,473,504 | B2 * | 1/2009 | Yanagawa et al. | 430/58.7 |
| 2006/0105254 | A1 | 5/2006 | Wu et al. | |
| 2007/0212627 | A1 * | 9/2007 | Yanagawa et al. | 430/58.75 |

OTHER PUBLICATIONS

Jin Wu et al., U.S. Application No. (Not yet assigned) on Ketal Containing Photoconductors, filed Dec. 20, 2007.
Jin Wu et al., U.S. Application No. (Not yet assigned) on Phosphine Oxide Containing Photoconductors, filed concurrently herewith, Dec. 20, 2007.
Jin Wu, U.S. Application No. (Not yet assigned) on Aminoketone Containing Photoconductors, filed concurrently herewith, Dec. 20, 2007.
Jin Wu et al., U.S. Application No. (Not yet assigned) on Nitrogen Heterocyclics Containing Photoconductors, filed concurrently herewith, Dec. 20, 2007.
Jin Wu, U.S. Application No. (Not yet assigned) on Benzophenone Containing Photoconductors, filed concurrently herewith, Dec. 20, 2007.
Jin Wu, U.S. Appl. No. 11/831,440 on Additive Containing Photogenerating Layer Photoconductors, filed Jul. 31, 2007.
Jin Wu et al., U.S. Appl. No. 11/869,258 on Imidazolium Salt Containing Charge Transport Layer Photoconductors, filed Oct. 9, 2007.
Jin Wu et al., U.S. Appl. No. 11/869,252 on Additive Containing Charge Transport Layer Photoconductors, filed Oct. 9, 2007.
Jin Wu et al., U.S. Appl. No. 11/869,231 on Additive Containing Photogenerating Layer Photoconductors, filed Oct. 9, 2007.
Liang-Bih Lin et al., U.S. Appl. No. 11/800,129 on Photoconductors, filed May 4, 2007.
Liang-Bih Lin et al., U.S. Appl. No. 11/800,108 on Photoconductors, filed May 4, 2007.
Jin Wu et al., U.S. Appl. No. 11/869,269 on Charge Trapping Releaser Containing Charge Transport Layer Photoconductors, filed Oct. 9, 2007.
Jin Wu et al., U.S. Appl. No. 11/848,428 on Photoconductors, filed Aug. 31, 2007.
Jin Wu, U.S. Appl. No. 11/848,417 on Light Stabilizer Containing Photoconductors, filed Aug. 31, 2007.
Jin Wu, U.S. Appl. No. 11/848,439 on Boron Containing Photoconductors, filed Aug. 31, 2007.
Jin Wu, U.S. Appl. No. 11/848,448 on Triazole Containing Photoconductors, filed Aug. 31, 2007.
Liang-Bih Lin et al., U.S. Appl. No. 11/848,454 on Hydroxy Benzophenone Containing Photoconductors, filed Aug. 31, 2007.
Jin Wu et al., U.S. Appl. No. 11/472,765 on Titanyl Phthalocyanine Photoconductors, filed Jun. 22, 2006.
Jin Wu et al., U.S. Appl. No. 11/472,766 on Titanyl Phthalocyanine Photoconductors, filed Jun. 22, 2006.
John F. Yanus et al., U.S. Appl. No. 11/593,657 on Overcoated Photoconductors With Thiophosphate Containing Charge Transport Layers, filed Nov. 7, 2006.
Jin Wu et al., U.S. Appl. No. 11/728,007 on Overcoated Photoconductors Containing Fluorinated Components, filed Mar. 23, 2007.

* cited by examiner

*Primary Examiner*—Mark A Chapman
(74) *Attorney, Agent, or Firm*—Oliff & Berridge, PLC

(57) ABSTRACT

A photoconductor that includes, for example, a supporting substrate, a photogenerating layer, and at least one charge transport layer comprised of at least one charge transport component, and an overcoat, and where the overcoat contains at least one of ketal. In embodiments the overcoat layer may include α-hydroxyketone, α-diketone, or mixtures thereof.

35 Claims, No Drawings

PHOTOCONDUCTORS CONTAINING KETAL OVERCOATS

CROSS REFERENCE TO RELATED APPLICATIONS

U.S. application Ser. No. 11/961,462, U.S. Publication No. 20090162765, filed Dec. 20, 2007, entitled Ketal Containing Photoconductors, the disclosure of which is totally incorporated herein by reference, discloses a photoconductor comprising a supporting substrate, a photogenerating layer, and at least one charge transport layer comprised of at least one charge transport component, and wherein the at least one charge transport layer contains at least one ketal.

U.S. application Ser. No. 11/961,482, U.S. Publication No. 20090162769, filed Dec. 20, 2007, entitled Phosphine Oxide Containing Photoconductors, the disclosure of which is totally incorporated herein by reference, discloses a photoconductor comprising a supporting substrate, a photogenerating layer, and at least one charge transport layer comprised of at least one charge transport component, and wherein the at least one charge transport layer contains at least one phosphine oxide.

U.S. application Ser. No. 11/961,506, U.S. Publication No. 20090162768, filed Dec. 20, 2007, entitled Aminoketone Containing Photoconductors, the disclosure of which is totally incorporated herein by reference, discloses a photoconductor comprising a supporting substrate, a photogenerating layer, and at least one charge transport layer comprised of at least one charge transport component, and wherein the at least one charge transport layer contains at least one aminoketone.

U.S. application Ser. No. 11/961,561, U.S. Publication No. 20090162764, filed Dec. 20, 2007, entitled Nitrogen Heterocyclics Containing Photoconductors, the disclosure of which is totally incorporated herein by reference, discloses a photoconductor comprising a supporting substrate, a photogenerating layer, and at least one charge transport layer comprised of at least one charge transport component, and a triazine.

U.S. application Ser. No. 11/961,566, U.S. Publication No. 20090162767, filed Dec. 20, 2007, entitled Benzophenone Containing Photoconductors, the disclosure of which is totally incorporated herein by reference, discloses a photoconductor comprising a supporting substrate, a photogenerating layer, and at least one charge transport layer comprised of at least one charge transport component, and wherein the charge transport layer contains a benzophenone.

U.S. application Ser. No. 11/831,440, U.S. Publication No. 20090035673, filed Jul. 31, 2007 by Jin Wu, entitled Iron Containing Hole Blocking Layer Containing Photoconductors, the disclosure of which is totally incorporated herein by reference, discloses a photoconductor comprising a substrate; an undercoat layer thereover wherein the undercoat layer comprises a metal oxide, and an iron containing compound; a photogenerating layer; and at least one charge transport layer.

U.S. application Ser. No. 11/869,258, U.S. Publication No. 20090092912, filed Oct. 9, 2007 by Jin Wu et al., entitled Imidazolium Salt Containing Charge Transport Layer Photoconductors, the disclosure of which is totally incorporated herein by reference, discloses a photoconductor comprising a supporting substrate, a photogenerating layer, and at least one charge transport layer comprised of at least one charge transport component, and where at least one charge transport layer contains at least one imidazolium salt.

U.S. application Ser. No. 11/869,252, U.S. Publication No. 20090092911, filed Oct. 9, 2007 by Jin Wu et al., entitled Additive Containing Charge Transport Layer Photoconductors, the disclosure of which is totally incorporated herein by reference, discloses a photoconductor comprising a supporting substrate, a photogenerating layer, and at least one charge transport layer comprised of at least one charge transport component, and an ammonium salt additive or dopant.

U.S. application Ser. No. 11/869,231, U.S. Publication No. 20090092913, filed Oct. 9, 2007 by Jin Wu et al., entitled Additive Containing Photogenerating Layer Photoconductors, the disclosure of which is totally incorporated herein by reference, discloses a photoconductor comprising a supporting substrate, a photogenerating layer, and at least one charge transport layer comprised of at least one charge transport component, and wherein the photogenerating layer contains at least one of an ammonium salt and an imidazolium salt.

U.S. application Ser. No. 11/800,129, U.S. Publication No. 20080274419, filed May 4, 2007 by Liang-Bih Lin et al., entitled Photoconductors, the disclosure of which is totally incorporated herein by reference, discloses a photoconductor comprising a supporting substrate, a photogenerating layer, and at least one charge transport layer comprised of at least one charge transport component, and wherein the photogenerating layer contains a bis(pyridyl)alkylene.

U.S. application Ser. No. 11/800,108, now U.S. Pat. No. 7,662,526, filed May 4, 2007 by Liang-Bih Lin et al., entitled Photoconductors, the disclosure of which is totally incorporated herein by reference, discloses a photoconductor comprising a supporting substrate, a photogenerating layer, and at least one charge transport layer comprised of at least one charge transport component, and wherein the charge transport layer contains a benzoimidazole.

U.S. application Ser. No. 11/869,269, now U.S. Pat. No. 7,709,169, filed October 9, 2007 by Jin Wu, entitled Charge Trapping Releaser Containing Charge Transport Layer Photoconductors, the disclosure of which is totally incorporated herein by reference, discloses a photoconductor comprised of a supporting substrate, a photogenerating layer, and at least one charge transport layer comprised of at least one charge transport component, and wherein the at least one charge transport layer contains at least one charge trapping releaser.

U.S. application Ser. No. 11/848,428, U.S. Publication No. 20090061337, filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein the photogenerating layer contains a triazine.

U.S. application Ser. No. 11/848,417, U.S. Publication No. 20090061336, filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein the photogenerating layer contains a light stabilizer.

U.S. application Ser. No. 11/848,439, now U.S. Pat. No. 7,670,738, filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein the photogenerating layer contains a boron compound.

U.S. application Ser. No. 11/848,448, U.S. Publication No. 20090061339, filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein the photogenerating layer contains a triazole.

U.S. application Ser. No. 11/848,454, U.S. Publication No. 20090061340, filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein the photogenerating layer contains a hydroxyalkoxy benzophenone.

In U.S. application Ser. No. 11/472,765, now U.S. Pat. No. 7,553,593, filed Jun. 22, 2006, and U.S. application Ser. No. 11/472,766, now U.S. Pat. No. 7,485,398, filed Jun. 22, 2006, the disclosures of which are totally incorporated herein by reference, there is disclosed, for example, photoconductors comprising a photogenerating layer and a charge transport layer, and wherein the photogenerating layer contains a titanyl phthalocyanine prepared by dissolving a Type I titanyl phthalocyanine in a solution comprising a trihaloacetic acid and an alkylene halide; adding the mixture comprising the dissolved Type I titanyl phthalocyanine to a solution comprising an alcohol and an alkylene halide thereby precipitating a Type Y titanyl phthalocyanine; and treating the Type Y titanyl phthalocyanine with a monohalobenzene.

High photosensitivity titanyl phthalocyanines are illustrated in copending U.S. application Ser. No. 10/992,500, U.S. Publication No. 20060105254, the disclosures of which are totally incorporated herein by reference, which, for example, discloses a process for the preparation of a Type V titanyl phthalocyanine, comprising providing a Type I titanyl phthalocyanine; dissolving the Type I titanyl phthalocyanine in a solution comprising a trihaloacetic acid and an alkylene halide like methylene chloride; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monochlorobenzene to yield a Type V titanyl phthalocyanine.

U.S. application Ser. No. 11/593,657, U.S. Publication No. 20080107984, filed Nov. 7, 2006, the disclosure of which is totally incorporated herein by reference, illustrates an imaging member comprising an optional supporting substrate, a photogenerating layer, and at least one charge transport layer, and wherein at least one charge transport layer contains at least one charge transport component and at least one thiophosphate; and an overcoating layer in contact with and contiguous to the charge transport layer, and which overcoating is comprised of an acrylated polyol, a polyalkylene glycol, a crosslinking component, and a charge transport component.

U.S. application Ser. No. 11/728,007, now U.S. Pat. No. 7,749,668, filed Mar. 23, 2007, the disclosure of which is totally incorporated herein by reference, illustrates a photoconductor comprising an optional supporting substrate, a photogenerating layer, at least one charge transport layer, and an overcoating layer in contact with and contiguous to the charge transport layer, and which overcoating is comprised of a fluoroalkyl ester, and a polymer.

A number of the components of the above cross referenced applications, such as the supporting substrates, resin binders, antioxidants, charge transport components, photogenerating pigments like hydroxygallium phthalocyanines, and titanyl phthalocyanines, high photosensitivity titanyl phthalocyanines, such as Type V, hole blocking layer components, adhesive layers, and the like, may be selected for the photoconductor and imaging members of the present disclosure in embodiments thereof.

BACKGROUND

In embodiments there is disclosed herein a photoconductor comprised of an overcoating containing a ketal as illustrated herein. More specifically, the present disclosure is directed to multilayered drum, or flexible, belt photoconductors, or devices comprised of a supporting medium like a substrate, a photogenerating layer, a charge transport layer, including a plurality of charge transport layers, such as a first charge transport layer and a second charge transport layer, and an overcoat, and wherein the overcoat in contact with the charge transport layer contains a photoinitiator like a ketal, an α-hydroxyketone, an α-diketone, a phosphine oxide, an α-aminoketone, and mixtures thereof. Moreover, in embodiments there is disclosed a photoconductor with a photogenerating layer, a charge transport layer, and an overcoat containing a ketal of at least one of a benzil ketal, a benzoin ether, and an α-dialkoxy acetophenone. In embodiments, the photoconductors disclosed enable, it is believed, for example, undesirable light shock reductions; the minimization or substantially elimination of undesirable ghosting on developed images, such as xerographic images, including improved ghosting at various relative humidity; excellent cyclic and stable electrical properties; minimal charge deficient spots (CDS); and compatibility with the photogenerating, charge transport and overcoat resin binders. Light shock or photoconductor fatigue usually causes dark bands in the resulting xerographic prints from the light exposed photoconductor area at time zero, while the photoconductors disclosed herein in embodiments minimize or avoid this disadvantage in that, for example, the light shock resistant photoconductors do not usually print undesirable dark bands even when the photoconductor is exposed to light.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

There is illustrated in U.S. Pat. No. 7,037,631 a photoconductive imaging member comprised of a supporting substrate, a hole blocking layer thereover, a crosslinked photogenerating layer and a charge transport layer, and wherein the photogenerating layer is comprised of a photogenerating component, and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990 wherein there is illustrated an imaging member comprised of a photogenerating layer, and an aryl amine hole transport layer. Examples of disclosed photogenerating layer components include trigonal selenium, metal phthalocyanines, vanadyl phthalocyanines, and metal free phthalocyanines.

In U.S. Pat. No. 4,921,769, there are illustrated photoconductive imaging members with blocking layers of certain polyurethanes.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, hydrolyzing said pigment precursor chlorogallium phthalocyanine Type I by standard methods, for example acid pasting, subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer.

Kanemitsu and Funada (*J. Phys. D: Appl. Phys.* 24, 1991, 1409-1415) have apparently suggested that light-induced fatigue of the photoconductor is a consequence of the build-up of the negative charges caused by electron trapping in the photogenerating layer and the positive charges caused by hole trapping at the photogenerating layer charge transport layer interface. The photoconductors illustrated herein in embodiments, and with an additive, such as a triazine, and those additives illustrated in the appropriate copending applications filed concurrently herewith, in the charge transport layer results in reduced light shock characteristics as compared to a similar photoconductor with no charge transport layer (CTL) additive as the additive is believed to absorb the UV portion of the white light and generate active species such as free radicals that can interact with or neutralize those light (usually visible light) generated charges within the photoconductor.

The appropriate components, such as the supporting substrates, the photogenerating layer components, the charge transport layer components, the overcoat layer components, and the like of the above-recited patents, may be selected for the photoconductors of the present disclosure in embodiments thereof.

EMBODIMENTS

Disclosed herein is a photoconductor comprising a supporting substrate, a photogenerating layer, and at least one charge transport layer comprised of at least one charge transport component, and an overcoat layer in contact with and contiguous to the charge transport layer, and which overcoat is comprised of a crosslinked polymeric network, an overcoat charge transport component, and at least one ketal; a photoconductor comprised in sequence of an optional supporting substrate, a photogenerating layer; a charge transport layer; and a ketal containing top overcoat layer, and wherein the overcoat ketal is a benzil ketal component present in an amount of from about 0.05 to about 20 weight percent; and a photoconductor comprising a supporting substrate, a photogenerating layer, a hole transport layer, and thereover an overcoat layer, and wherein the overcoat layer has incorporated therein a benzil ketal as represented by or encompassed by

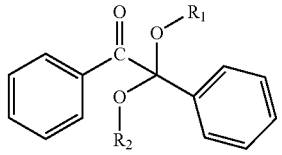

wherein $R_1$ and $R_2$ are each independently at least one of hydrogen, alkyl, and aryl, and other known suitable substituents, and wherein the overcoat layer is in contact with and contiguous to the hole transport layer, and which overcoat is comprised of an acrylated polyol, a polyalkylene glycol, a crosslinking component, and a charge transport component.

Examples of photoinitiators included in the overcoat layer of the photoconductor include known ketals, α-hydroxyketone, α-diketone, phosphine oxide, α-aminoketone photoinitiators used in UV curing. While not be desired to be limited by theory, it is believed that upon UV exposure activated species, such as free radicals, are generated by a unimolecular reaction, mainly bond breakage within the photoinitiator molecule itself, and the UV-generated active species from the photoinitiator would interact with or neutralize that light, usually visible light, generated charges within the photoconductor, resulting in improved light shock resistance. Some commercial photoinitiators selected for the overcoat are available as ESACURE® of LAMBERTI Chemical Specialties, Gallarate, Italy, IRGACURE® and DAROCUR® of Ciba Specialty Chemicals, Basel, Switzerland, FIRSTCURE® of Albemarle Corporation, Baton Rouge, La., and LUCIRIN® of BASF, Ludwigshafen, Germany.

Ketal photoinitiator examples present in various suitable amounts, such as from about 0.001 to about 20, from about 0.01 to about 10, from about 0.1 to about 5 weight percent based on the overcoat layer components, include those represented by the following formulas/structures

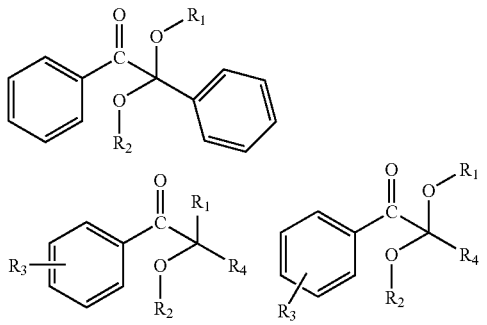

wherein each R substituent is, for example, hydrogen, alkyl, aryl, substituted alkyl, substituted aryl, and the like.

Alkyl includes, for example, those groups with from 1 to about 25, from 1 to about 18, from 1 to about 10, or from 1 to about 6 carbon atoms, such as methyl, ethyl, propyl, butyl, pentyl, hexyl, octyl, stearyl, and the like. Aryl refers, for example, to those groups that contain from 6 to about 42 carbon atoms, such as phenyl, anthryl, naphthyl, and the like.

Specific ketal examples include α,α-dimethoxy-α-phenylacetophenone (ESACURE® KB1, IRGACURE® 651 and FIRSTCURE® BDK), 2,2-diethoxyacetophenone (FIRSTCURE® DEAP), benzoin ethyl ether, benzoin isobutyl ether, benzoin methyl ether, respectively, represented by the following formulas/structures

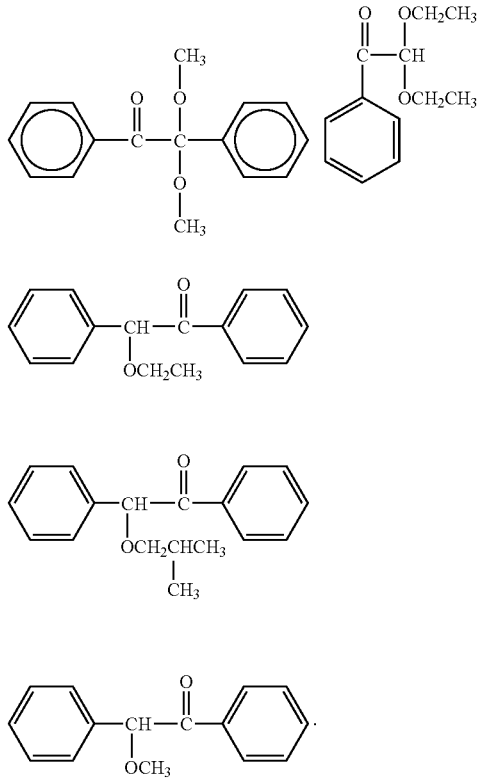

Alpha-hydroxyketone examples present in the overcoat in various suitable amounts, such as from about 0.001 to about 20, from about 0.01 to about 10, from about 0.1 to about 5 weight percent based on the overcoat layer components, include those represented by the following formula/structure

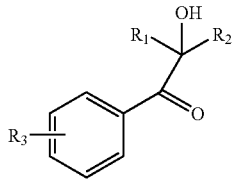

wherein each R substituent is hydrogen, alkyl, aryl, substituted derivatives thereof, and the like as illustrated herein.

Specific α-hydroxyketone examples present in the overcoat include 1-hydroxycyclohexylphenyl-ketone (ESACURE® KS300, IRGACURE® 184, and FIRSTCURE® HCPK), 2-hydroxy-2-methyl-1-phenyl-1-propanone (DAROCUR® 1173, ESACURE® KL200, and FIRSTCURE® HMPP), dimer of 2-hydroxy-2-methyl-1-phenyl-1-propanone (IRGACURE® 127), oligo[2-hydroxy-2-methyl-1-[4-(1-methylvinyl)phenyl]propanone] (n=2, ESACURE® ONE; n>2, ESACURE® KIP150), anisoin, benzoin, 2-hydroxy-1-[4-(2-hydroxyethoxy)phenyl]-2-methyl-1-propanone (IRGACURE® 2959), respectively, represented by the following formulas/structures

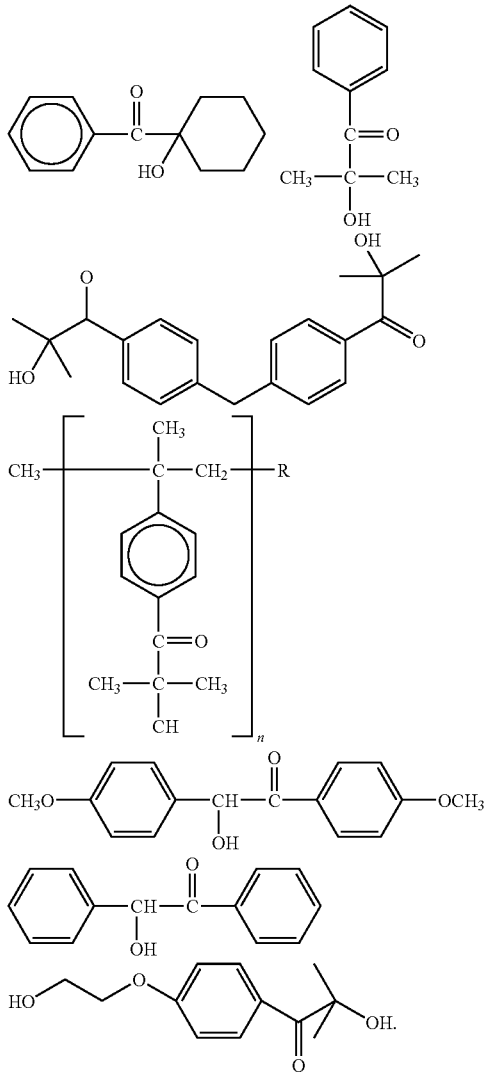

Alpha-diketone examples present in the overcoat in various suitable amounts, such as from about 0.001 to about 20, from about 0.01 to about 10, from about 0.1 to about 5 weight percent based on the overcoat layer components, include those represented by the following formula/structure

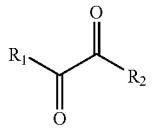

wherein each R substituent is hydrogen, alkyl, aryl, substituted derivatives thereof, and the like as illustrated herein.

The photoconductors disclosed herein include a protective overcoat layer (POC) usually in contact with and contiguous to the charge transport layer. This POC layer is comprised of components that include (i) a polyol and/or acrylated polyol, and (ii) an alkylene glycol polymer, such as polypropylene glycol where the proportion of the acrylated polyol to the polypropylene glycol is, for example, from about 0.1:0.9 to about 0.9:0.1, at least one charge transport compound, and at least one crosslinking agent, and a ketal. The overcoat composition can comprise as a first polymer of a polyol and/or acrylated polyol with a hydroxyl number of from about 10 to about 20,000, a second polymer of an alkylene glycol with, for example, a weight average molecular weight of from about 100 to about 20,000, from about 400 to about 5,000, or from about 1,000 to about 2,000, a charge transport compound, an acid catalyst, and a crosslinking agent wherein the overcoat layer, which is crosslinked, contains polyols, such as a polyol and/or acrylated polyol and a glycol, a crosslinking agent residue, charge transport compound and a catalyst residue, all reacted into a polymeric network. While the percentage of crosslinking can be difficult to determine and not be desired to be limited by theory, the overcoat layer is crosslinked to a suitable value, such as for example, from about 5 to about 50 percent, from about 5 to about 25 percent, from about 10 to about 20 percent, and in embodiments from about 40 to about 65 percent. Excellent photoconductor electrical response can also be achieved when the prepolymer hydroxyl groups, and the hydroxyl groups of the dihydroxy aryl amine (DHTBD) are stoichiometrically less than the available methoxy alkyl on the crosslinking, such as CYMEL® moieties.

The prepolymer contains a reactive group selected from the group consisting of hydroxyl and carboxylic acid. The term "prepolymer" refers, for example, to a monomer or low molecular weight polymer that contains reactive groups and forms a crosslinked polymer network when reacted with a crosslinking agent. Low molecular weight polymers are formed by the reaction of monomers resulting in very short polymers containing from about 5 to about 100 units. These short polymers can exhibit poor mechanical properties. Increasing chain length to from about 500 to about 1,000 units is of value with regard to achieving a number of polymer properties. Crosslinked systems include those where the chain length is difficult to determine, or in some instances cannot be determined due to insolubility of the system. Polymer chains are two dimensions, while crosslinking creates three dimensional networks. In embodiments, the prepolymer is a monomer or low molecular weight polymer containing hydroxyl or carboxylic acid.

The photoreceptor overcoat can be applied by a number of different processes inclusive of dispersing the overcoat composition in a solvent system, and applying the resulting overcoat coating solution onto the receiving surface, for example, the top charge transport layer of the photoreceptor to a thickness of, for example, from about 0.5 micron to about 10, or from 0.5 to about 8 microns.

According to various embodiments, the crosslinkable polymer present in the overcoat layer can comprise a mixture of a polyol and an acrylated polyol film forming resin, and where, for example, the crosslinkable polymer can be electrically insulating, semiconductive or conductive, and can be charge transporting or free of charge transporting characteristics. Examples of polyols include a highly branched polyol where highly branched refers, for example, to a prepolymer synthesized using a sufficient amount of trifunctional alcohols, such as triols, or a polyfunctional polyol with a high hydroxyl number to form a polymer comprising a number of branches off of the main polymer chain. The polyol can possess a hydroxyl number of, for example, from about 10 to about 10,000 and can include ether groups, or can be free of ether groups. Suitable acrylated polyols can be, for example, generated from the reaction products of propylene oxide modified with ethylene oxide, glycols, triglycerol, and the like, and wherein the acrylated polyols can be represented by the following formula (2)

$$[R_t—CH_2]_t—[—CH_2—R_a—CH_2]_p—[—CO—R_b—CO—]_n—[—CH_2—R_c—CH_2]_p—[—CO—_d—CO—]_q \quad (2)$$

wherein $R_t$ represents $CH_2CR_1CO_2$—, $R_1$ is alkyl with, for example, from 1 to about 25 carbon atoms, and more specifically, from 1 to about 12 carbon atoms, such as methyl, ethyl, propyl, butyl, hexyl, heptyl, and the like; $R_a$ and $R_c$ independently represent linear alkyl groups, alkoxy groups, branched alkyl or branched alkoxy groups with alkyl and alkoxy groups possessing, for example, from 1 to about 20 carbon atoms; $R_b$ and $R_d$ independently represent alkyl or alkoxy groups having, for example, from 1 to about 20 carbon atoms; and m, n, p, and q represent mole fractions of from 0 to 1, such that n+m+p+q=1. Examples of commercial acrylated polyols are JONCRYL™ polymers, available from Johnson Polymers Inc. and POLYCHEM™ polymers, available from OPC polymers.

The overcoat layer includes in embodiments a crosslinking agent and catalyst where the crosslinking agent can be, for example, a melamine crosslinking agent or accelerator. Incorporation of a crosslinking agent can provide reaction sites to interact with the acrylated polyol to provide a branched, crosslinked structure. When so incorporated, any suitable crosslinking agent or accelerator can be used, including, for example, trioxane, melamine compounds, and mixtures thereof. When melamine compounds are selected, they can be functionalized, examples of which are melamine formaldehyde, methoxymethylated melamine compounds, such as glycouril-formaldehyde and benzoguanamine-formaldehyde, and the like. In some embodiments, the crosslinking agent can include a methylated, butylated melamine-formaldehyde. A nonlimiting example of a suitable methoxymethylated melamine compound can be CYMEL® 303 (available from Cytec Industries), which is a methoxymethylated melamine compound with the formula $(CH_3OCH_2)_6N_3C_3N_3$ and the following structure

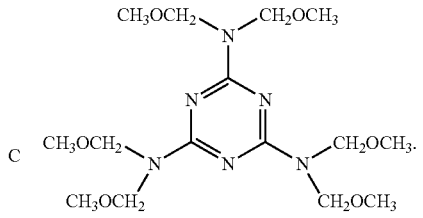

Crosslinking can be accomplished by heating the overcoat components in the presence of a catalyst. Non-limiting examples of catalysts include oxalic acid, maleic acid, carbolic acid, ascorbic acid, malonic acid, succinic acid, tartaric acid, citric acid, p-toluenesulfonic acid, methanesulfonic acid, and the like, and mixtures thereof.

A blocking agent can also be included in the overcoat layer, which agent can "tie up" or substantially block the acid catalyst effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine, triethylamine, and the like as well as commercial acid solutions containing blocking agents such as CYCAT® 4045, available from Cytec Industries Inc.

The temperature used for crosslinking varies with the specific catalyst, the catalyst amount, heating time utilized, and the degree of crosslinking desired. Generally, the degree of crosslinking selected depends upon the desired flexibility of the final photoreceptor. For example, complete crosslinking, that is 100 percent, may be used for rigid drum or plate photoreceptors. However, partial crosslinking, for example from about 20 percent to about 80 percent, is usually selected for flexible photoreceptors having, for example, web or belt configurations. The amount of catalyst to achieve a desired degree of crosslinking will vary depending upon the specific coating solution materials, such as polyol/acrylated polyol, catalyst, temperature, and time used for the reaction. Specifically, the polyester polyol/acrylated polyol is crosslinked at a temperature between about 100° C. and about 150° C. A typical crosslinking temperature used for polyols/acrylated polyols with p-toluenesulfonic acid as a catalyst is less than about 140° C., for example 135° C., for about 1 minute to about 40 minutes. A typical concentration of acid catalyst is from about 0.01 to about 5 weight percent based on the weight of polyol/acrylated polyol. After crosslinking, the overcoating should be substantially insoluble in the solvent in which it was soluble prior to crosslinking, thus permitting no overcoating material to be removed when rubbed with a cloth soaked in the solvent. Crosslinking results in the development of a three-dimensional network which restrains the transport molecule in the crosslinked polymer network.

The overcoat layer can also include a charge transport material to, for example, improve the charge transport mobility of the overcoat layer. According to various embodiments, the charge transport material can be selected from the group consisting of at least one of (i) a phenolic substituted aromatic amine, (ii) a primary alcohol substituted aromatic amine, and (iii) mixtures thereof. In embodiments, the charge transport material can be a terphenyl of, for example, an alcohol soluble dihydroxy terphenyl diamine, an alcohol-soluble dihydroxy TPD, and the like. An example of a terphenyl charge transporting molecule can be represented by the following formula

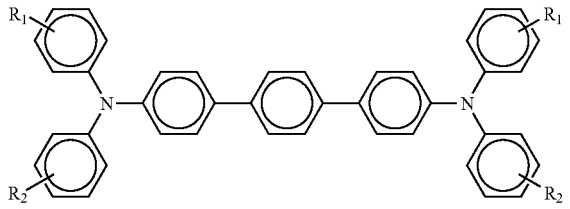

wherein each $R_1$ is —OH; and $R_2$ is alkyl (—$C_nH_{2n+1}$) where, for example, n is from 1 to about 10, from 1 to about 5, or from about 1 to about 6; and aralkyl and aryl groups with, for example, from about 6 to about 30, or about 6 to about 20 carbon atoms. Suitable examples of aralkyl groups include, for example, —$C_nH_{2n}$-phenyl groups where n is, for example, from about 1 to about 5 or from about 1 to about 10. Suitable examples of aryl groups include, for example, phenyl, naphthyl, biphenyl, and the like. In one embodiment, each $R_1$ is —OH to provide a dihydroxy terphenyl diamine hole transporting molecule. For example, where each $R_1$ is —OH and each $R_2$ is —H, the resultant compound is N,N'-diphenyl-N, N'-di[3-hydroxyphenyl]-terphenyl-diamine. In another embodiment, each $R_1$ is —OH, and each $R_2$ is independently an alkyl, aralkyl, or aryl group as defined above. In various embodiments, the charge transport material is soluble in the selected solvent used in forming the overcoat layer.

Any suitable secondary or tertiary alcohol solvent can be employed for the deposition of the film forming overcoat layer. Typical alcohol solvents include, but are not limited to, for example, tert-butanol, sec-butanol, 2-propanol, 1-methoxy-2-propanol, and the like, and mixtures thereof. Other suitable co-solvents that can be selected for the forming of the overcoat layer include, for example, tetrahydrofuran, monochlorobenzene, and mixtures thereof. These co-solvents can be used as diluents for the above alcohol solvents, or they can be omitted. However, in some embodiments, it may be of value to minimize or avoid the use of higher boiling alcohol solvents since they should be removed as they may interfere with efficient crosslinking.

In embodiments, the components, including the crosslinkable polymer, charge transport material, crosslinking agent, acid catalyst, and blocking agent, utilized for the overcoat solution should be soluble or substantially soluble in the solvent or solvents employed for the overcoat.

The thickness of the overcoat layer, which can depend upon the abrasiveness of the charging (for example bias charging roll), cleaning (for example blade or web), development (for example brush), transfer (for example bias transfer roll), in the system employed is, for example, from about 1 to about 15 microns from about 1 to about 3 microns, and from 1 to about 2 microns. In various embodiments, the thickness of the overcoat layer can be from about 1 micron to about 5 microns. Typical application techniques for applying the overcoat layer over the photoconductive layer can include spraying, dip coating, roll coating, wire wound rod coating, and the like. Drying of the deposited overcoat layer can be effected by any suitable conventional technique such as oven drying, infrared radiation drying, air drying, and the like. The dried overcoat layer of this disclosure should in embodiments transport charges during imaging, such as xerographic imaging.

In the dried overcoat layer, the composition can include from about 40 to about 90 percent by weight of film forming crosslinkable polymer, and from about 60 to about 10 percent by weight of a charge transport material. For example, in embodiments, the charge transport material can be incorporated into the overcoat layer in an amount of from about 20 to about 50 percent by weight. As desired, the overcoat layer can also include other materials, such as conductive fillers, abrasion resistant fillers, and the like, in any suitable and known amounts.

Although not desired to be limited by theory, the crosslinking agent can be located in the central region with the polymers like the acrylated polyol, polyalkylene glycol, and also charge transport component being associated with the crosslinking agent, and extending in embodiments from the central region.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants, such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ PS (available from Sumitomo Chemical Co., Ltd.); thioether antioxidants, such as SUMILIZER™ TP-D (available from Sumitomo Chemical Co., Ltd); phosphite antioxidants, such as MARK™ 2112, PEP-8, PEP-24G, PEP-36, 329K and HP-10 (available from Asahi Denka Co., Ltd.); other molecules, such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Photoconductor Layer Examples

The thickness of the photoconductor substrate layer depends on various factors, including economical considerations, desired electrical characteristics, adequate flexibility, and the like, thus this layer may be of substantial thickness, for example over 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 microns to about 300 microns, or from about 100 to about 150 microns. In embodiments, the photoconductor can be free of a substrate, for example a layer usually in contact with the substrate can be increased in thickness. For a photoconductor drum, the substrate or supporting medium may be of a substantial thickness of, for example, up to several centimeters or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device.

Also, the photoconductor may in embodiments include a blocking layer, an adhesive layer, a top overcoating protective layer, and an anticurl backing layer.

The photoconductor substrate may be opaque, substantially opaque, or substantially transparent, and may comprise any suitable material that, for example, permits the photoconductor layers to be supported. Accordingly, the substrate may comprise a number of known layers, and more specifically, the substrate can be comprised of an electrically nonconductive or conductive material such as an inorganic or an organic composition. As electrically nonconducting materials, there may be selected various resins known for this purpose including polyesters, polycarbonates, polyamides, polyurethanes, and the like, which are flexible as thin webs. An electrically conducting substrate may comprise any suitable metal of, for example, aluminum, nickel, steel, copper, and the like, or a polymeric material filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like.

In embodiments where the substrate layer is to be rendered conductive, the surface thereof may be rendered electrically conductive by an electrically conductive coating. The conductive coating may vary in thickness depending upon the optical transparency, degree of flexibility desired, and economic factors, and in embodiments this layer can be of a thickness of from about 0.05 micron to about 5 microns.

Illustrative examples of substrates are as illustrated herein, and more specifically, supporting substrate layers selected for the photoconductors of the present disclosure comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, and more specifically, alkylhydroxyl gallium phthalocyanines, hydroxygallium phthalocyanines, chlorogallium phthalocyanines, perylenes, especially bis(benzimidazo)perylene, titanyl phthalocyanines, and the like, and yet more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume.

In embodiments, the photogenerating component or pigment is present in a resinous binder in various amounts, inclusive of 100 percent by weight based on the weight of the photogenerating components that are present. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments, examples of polymeric binder materials that can be selected as the matrix for the photogenerating layer components are known and include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, and acrylonitrile copolymers, poly(vinyl chloride), vinyl chloride and vinyl acetate copolymers, acrylate copolymers, alkyd resins, cellulosic film formers, poly (amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an adhesive layer usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layer or layers for the imaging members of the present disclosure can contain a number of components including known hole blocking components, such as amino silanes, doped metal oxides, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene) bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer, which layer generally is of a thickness of from about 5 microns to about 75 microns, and more specifically, of a thickness of from about 10 microns to about 40 microns. Examples of charge transport components are aryl amines of the following formulas/structures

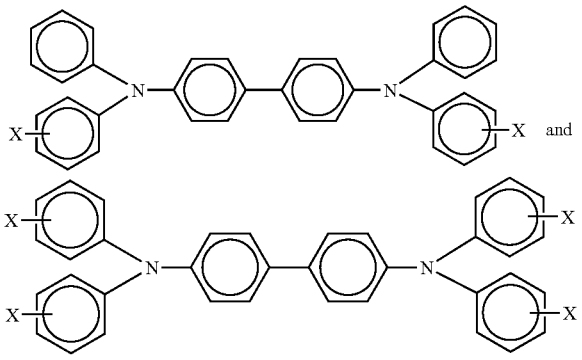

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

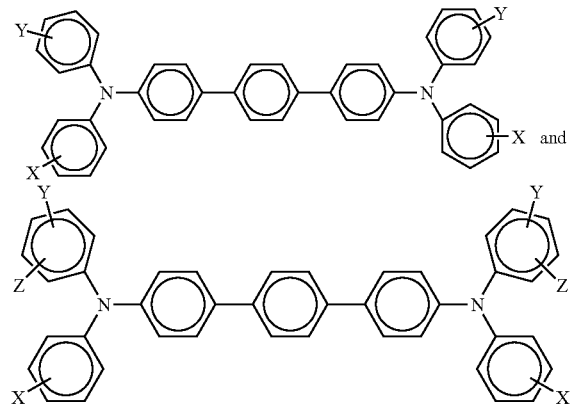

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidine-diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present in the charge transport layer, or layers, for example, in an amount of from about 50 to about 75 weight percent include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may in embodiments also be selected. The charge transport layer should be an insulator to the extent that an electrostatic charge placed on the hole transport layer is not usually conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances about 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional overcoating may be applied over the charge transport layer to provide abrasion protection.

Examples of components or materials optionally incorporated into the charge transport layers or at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

The present disclosure in embodiments thereof relates to a photoconductive member comprised of a supporting substrate, a photogenerating layer, a light shock reducing additive containing charge transport layer, and an overcoating charge transport layer; a photoconductive member with a photogenerating layer of a thickness of from about 0.1 to about 10 microns, and at least one transport layer each of a thickness of from about 5 to about 100 microns; a member wherein the thickness of the photogenerating layer is from about 0.1 to about 4 microns; a member or photoconductor wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, or titanized polyethylene terephthalate; a photoconductor wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; a photoconductor wherein each of the charge transport layers, especially a first and second charge transport layer, comprises

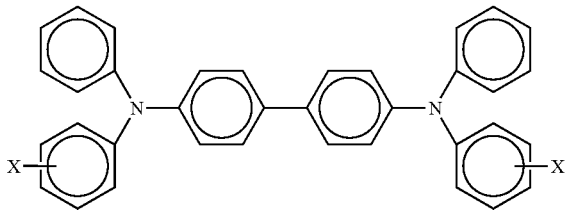

wherein X is selected from the group consisting of lower, that is with, for example, from 1 to about 8 carbon atoms, alkyl, alkoxy, aryl, and halogen; a photoconductor wherein each of, or at at least one of the charge transport layers comprises

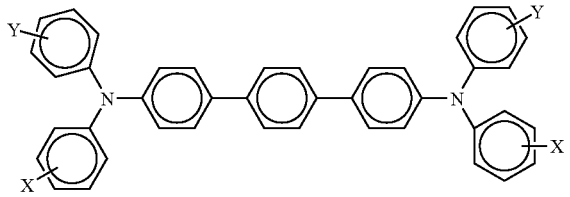

wherein X and Y are independently lower alkyl, lower alkoxy, phenyl, a halogen, or mixtures thereof, and wherein the photogenerating and charge transport layer resinous binder is selected from the group consisting of polycarbonates and polystyrene; a photoconductor wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on the photoconductor developing the latent image, and transferring the developed electrostatic image to a suitable substrate; a method of imaging wherein the imaging member is exposed to light of a wavelength of from about 370 to about 950 nanometers; a member wherein the photogenerating layer is of a thickness of from about 0.1 to about 50 microns; a member wherein the photogenerating pigment is dispersed in from about 1 weight percent to about 80 weight percent of a polymer binder; a member wherein the binder is present in an amount of from about 50 to about 90 percent by weight, and wherein the total of the layer components is about 100 percent; a photoconductor wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; a photoconductive imaging member comprised of a supporting substrate, a doped photogenerating layer, a hole transport layer, and in embodiments wherein a plurality of charge transport layers are selected, such as for example, from two to about ten, and more specifically two, may be selected; and a photoconductive imaging member comprised of an optional supporting substrate, a photogenerating layer, and a first, second, and third charge transport layer.

Primarily for purposes of brevity, the examples of each of the substituents, and each of the components/compounds/molecules, polymers (components) for each of the layers specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. Similarly, the thickness of each of the layers, the examples of components in each of the layers, the amount ranges of each of the components disclosed and claimed are not exhaustive, and it is intended that the present disclosure and claims encompass other suitable parameters not disclosed or that may be envisioned.

The following Examples are provided.

COMPARATIVE EXAMPLE 1

There was prepared a photoconductor with a biaxially oriented polyethylene naphthalate substrate (KALEDEX™ 2000) having a thickness of 3.5 mils, and thereover, a 0.02 micron thick titanium layer was coated on the biaxially oriented polyethylene naphthalate substrate (KALEDEX™ 2000). Subsequently, there was applied thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then deposited by applying a wet coating over the blocking layer, using a gravure applicator or an extrusion coater, and which adhesive contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micron.

The resulting photoconductor web was then coated with a charge transport layer. The charge transport layer was prepared by introducing into an amber glass bottle in a weight ratio of 50/50, N,N'-bis(methylphenyl)-1,1-biphenyl-4,4'-diamine (TBD) and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 20 microns. During this coating process, the humidity was equal to or less than 30 percent, for example 25 percent.

An overcoat coating solution was formed by adding 80 grams of 1-methoxy-2-propanol, 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N'-diphenyl-N,N'-di[3-hydroxyphenyl]-[1,1'-biphenyl]-4,4'-diamine (DHTBD), 1.5 grams of SILCLEAN™ 3700 (a hydroxy functionalized siloxane polyacrylate available from BYK-Chemie USA), and 1.4 grams of 20 percent p-toluenesulfonic acid in 1-methoxy-2-propanol solution together, and mixing for at least 2 hours before coating.

The photoconductor was then overcoated with the above prepared overcoat solution using a ⅛ mil Bird bar. The resultant film was dried in a forced air oven for 2 minutes at 125° C. to yield a highly crosslinked, 3 micron thick overcoat, and which overcoat was substantially insoluble in methanol or ethanol.

Example I

A photoconductor was prepared by repeating the process of Comparative Example 1 except that there was included in the overcoat solution layer 0.1 percent by weight of the additive alpha,alpha-dimethoxy-alpha-phenylacetophenone (IR- GACURE® 651, Ciba Specialty Chemicals, Basel, Switzerland), and which additive was soluble in the solution.

Example II

A photoconductor is prepared by repeating the process of Comparative Example 1 except that there is included in the overcoat layer 0.5 percent by weight of the additive alpha, alpha-dimethoxy-alpha-phenylacetophenone (IRGACURE® 651, Ciba Specialty Chemicals, Basel, Switzerland), and which additive is soluble in the solution.

Example III

A photoconductor is prepared by repeating the process of Example I except that there is included in the overcoat layer 0.2 percent by weight of the additive benzoin ethyl ether (Aldrich Chemical) and which additive is soluble in the solution.

Example IV

A photoconductor is prepared by repeating the process of Example I except that there is included in the overcoat layer 0.4 percent by weight of the additive benzoin isobutyl ether (Aldrich Chemical), and which additive is soluble in the solution.

Example V

A photoconductor is prepared by repeating the process of Example I except that there is included in the overcoat layer 0.4 percent by weight of the additive 2,2-diethoxyacetophenone (FIRSTCURE® DEAP, Albemarle Corporation, Baton Rouge, La.), and which additive is soluble in the solution.

Example VI

A photoconductor is prepared by repeating the process of Example I except that there is included in the overcoat layer 1 percent by weight of the additive benzoin methyl ether (Aldrich Chemical), and which additive is soluble in the solution.

Electrical Property Testing

The above prepared photoconductors of Comparative Example 1 and Example I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of 500 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

The photoconductors of Comparative Example 1 and Example I exhibited substantially identical PIDCs. Thus, incorporation of the additive into the overcoat layer did not adversely affect the electrical properties of the Example I photoconductor.

Light Shock Reduction

An in-house light shock test was performed for the above prepared photoconductor devices (Comparative Example 1 and Example I). A piece (3 inch by 8 inch) of each of the above prepared photoconductors was exposed under office light for 120 minutes, and the PIDCs were measured quickly after light exposure. As a comparison, another piece from the same photoconductor was measured for PIDC without any light exposure. The light shock results are summarized in Table 1.

TABLE 1

| | V(3.5 ergs/cm$^2$) of the Unexposed Piece (V) | V(3.5 ergs/cm$^2$) of the Exposed Piece (V) |
|---|---|---|
| Comparative Example 1 | 78 | 54 |
| Example I | 79 | 66 |

V(3.5 ergs/cm$^2$), which was the surface potential of the photoconductor when the exposure was 3.5 ergs/cm$^2$, was used to characterize the photoconductor. When the above belt photoconductors were exposed to a white light, V(3.5 ergs/cm$^2$) was reduced immediately after exposure, for example 5 minutes after, and then the photoconductor tended to recover from this surface potential drop by the light exposure after a period of rest, for example 24 hours later.

The disclosed photoconductor device (Example I) exhibited a 13V decrease in V(3.5 ergs/cm$^2$), or 16 percent in light shock percentage calculated as $[V(3.5\ ergs/cm^2)_{unexposed}-V(3.5\ ergs/cm^2)_{exposed}]/V(3.5\ ergs/cm^2)_{unexposed}$; whereas the controlled photoconductor of Comparative Example 1 exhibited a 24V decrease in V(3.5 ergs/cm$^2$) after light exposure, or 31 percent in light shock percentage, which indicated that the Example I photoconductor was more light shock resistant with less drop in V(3.5 ergs/cm$^2$) after light exposure.

Thus, incorporation of the above benzil ketal additive in the overcoat layer improved light shock resistance with the light shock percentage being about one half of that of the Comparative Example 1 photoconductor with no additive in the overcoat layer.

For an ideal photoconductor, V(3.5 ergs/cm$^2$) should usually remain unchanged whether the photoconductor is exposed to light or not.

Light shock, such as occurring with the photoconductor of Comparative Example 1 usually causes dark bands in xerographic prints when the photoconductor is exposed to light at t=0 (time zero). The light shock resistant Example I photoconductor did not xerographically print dark bands even when the photoconductor was exposed to white light.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and a charge transport layer comprised of at least one charge transport component, and an overcoat layer in contact with and contiguous to said charge transport layer, and which overcoat is comprised of a crosslinked polymeric network, an overcoat charge transport component, and at least one ketal, wherein said crosslinked polymeric network of said overcoat is comprised of at least one of a polyol and an acrylated polyol, a polyalkylene glycol, and a crosslinking component, and wherein said ketal is represented by at least one of

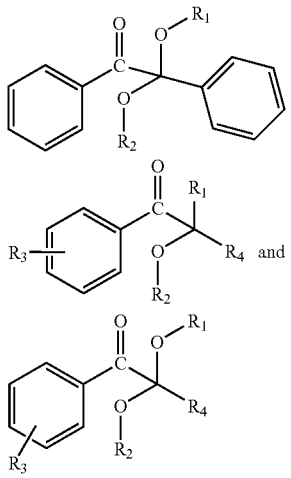

wherein each R substituent is independently at least one of hydrogen, alkyl, aryl, and substituted derivatives thereof, and wherein said ketal is present in an amount of from about 0.001 to about 20 weight percent.

2. A photoconductor in accordance with claim 1 wherein said alkyl contains from 1 to about 25 carbon atoms and said aryl contains from 6 to about 42 carbon atoms, and wherein said polyol and/or acrylated polyol has a hydroxyl number of from about 10 to about 20,000, and wherein said polyol and/or acrylated polyol, said polyalkylene polyol, said crosslinking component, and overcoat charge transport component are reacted in the presence of an acid catalyst to form said overcoat.

3. A photoconductor in accordance with claim 1 wherein said alkyl contains from 1 to about 12 carbon atoms, and said aryl contains from 6 to about 24 carbon atoms, and wherein said polyol and/or acrylated polyol has a hydroxyl number of from about 10 to about 20,000, and wherein said polyol and/or acrylated polyol, said polyalkylene polyol, said crosslinking component, and overcoat charge transport component are reacted in the presence of an acid catalyst to form said overcoat.

4. A photoconductor in accordance with claim 1 wherein said alkyl contains from 1 to about 6 carbon atoms, and said aryl contains from 6 to about 18 carbon atoms, and said overcoat further contains a catalyst, and said polyalkylene glycol is a polypropylene glycol.

5. A photoconductor in accordance with claim 1 wherein said alkyl is methyl and said aryl is phenyl, and wherein said overcoat further contains a catalyst, and said alkylene glycol is a polypropylene glycol.

6. A photoconductor in accordance with claim 1 wherein said ketal is selected from the group consisting of α, α-dimethoxy-α-phenylacetophenone, 2,2-diethoxyacetophenone, benzoin ethyl ether, benzoin isobutyl ether, benzoin methyl ether, and mixtures thereof.

7. A photoconductor in accordance with claim 1 wherein said ketal is alpha, alpha-dimethoxy-alpha-phenylacetophenone present in an amount of from about 0.1 to about 5 weight percent.

8. A photoconductor in accordance with claim 1 wherein said ketal is present in an amount of from about 0.001 to about 10 weight percent.

9. A photoconductor in accordance with claim 1 wherein said ketal is present in an amount of from about 0.01 to about 7 weight percent.

10. A photoconductor in accordance with claim 1 wherein said ketal is present in an amount of from about 0.1 to about 2 weight percent.

11. A photoconductor in accordance with claim 1 wherein alkyl is methyl, ethyl, propyl, butyl or pentyl, and said aryl is phenyl, naphthyl or anthryl, and wherein said overcoat further contains a catalyst, and said polyalkylene glycol is a polypropylene glycol.

12. A photoconductor in accordance with claim 1 wherein said charge transport component is comprised of at least one of aryl amine molecules

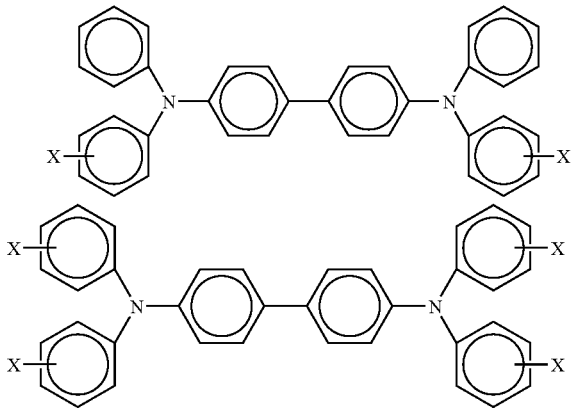

wherein X is selected from the group consisting of at least one of alkyl, alkoxy, aryl, and halogen.

13. A photoconductor in accordance with claim 12 wherein said alkyl and said alkoxy each contains from about 1 to about 12 carbon atoms, and said aryl contains from about 6 to about 36 carbon atoms.

14. A photoconductor in accordance with claim 12 wherein said aryl amine is N,N'-diphenyl-N,N-bis(3-methylphenyl)-1,1'- biphenyl-4,4'-diamine.

15. A photoconductor in accordance with claim 1 wherein said charge transport component is comprised of

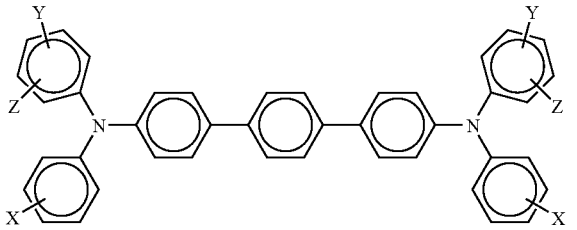

wherein X, Y and Z are independently selected from the group consisting of at least one of alkyl, alkoxy, aryl, and halogen.

16. A photoconductor in accordance with claim 15 wherein alkyl and alkoxy each contains from about 1 to about 12 carbon atoms, and aryl contains from about 6 to about 36 carbon atoms.

17. A photoconductor in accordance with claim 1 wherein said charge transport component is an aryl amine selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis (4-butylphenyl)-N,N'-di-o-tolyl-[p-terphenyl]-4,4"-diamine, N,N'-bis(4-butylphenyl) -N,N'-bis-(4-isopropylphenyl)-[p-terphenyl]-4,4"-diamine, N,N'-bis (4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and mixtures thereof, and wherein said at least one charge transport layer is from 1 to about 4.

18. A photoconductor in accordance with claim 1 further including in said charge transport layer an antioxidant comprised of at least one of a hindered phenolic and a hindered amine, and wherein said charge transport layer is from 1 to about 2 layers.

19. A photoconductor in accordance with claim 1 wherein said photogenerating layer is comprised of at least one photogenerating pigment.

20. A photoconductor in accordance with claim 19 wherein said photogenerating pigment is comprised of at least one of a metal phthalocyanine, a metal free phthalocyanine, and a perylene.

21. A photoconductor in accordance with claim 1 wherein said charge transport layer is comprised of a first and a second charge transport layer, and wherein said ketal is included in said overcoat layer in an amount of from about 0.01 to at least one of about 5 weight percent, and wherein said crosslinked polymeric network contains a polyol and an acrylated polyol, and a polyalkylene glycol with a weight/weight ratio of from about 2:8 to about 8:2 and a crosslinking agent, and said overcoat charge transport component is reacted with said polymeric network in the presence of a catalyst resulting in a crosslinked overcoat containing a polyol and/or acrylated polyol, a polyalkylene glycol, a crosslinking agent, a catalyst, and said overcoat charge transport component.

22. A photoconductor in accordance with claim 1 wherein said charge transport layer is comprised of 1, 2, or 3 layers.

23. A photoconductor in accordance with claim 1 wherein said overcoat charge transport component is selected from the group consisting of at least one of (i) a phenolic substituted aromatic amine, and (ii) a primary alcohol substituted aromatic amine.

24. A photoconductor in accordance with claim 1 wherein said overcoat charge transport component is

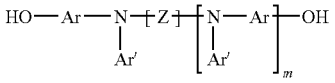

wherein m is zero or 1; Z is selected from the group consisting of at least one of

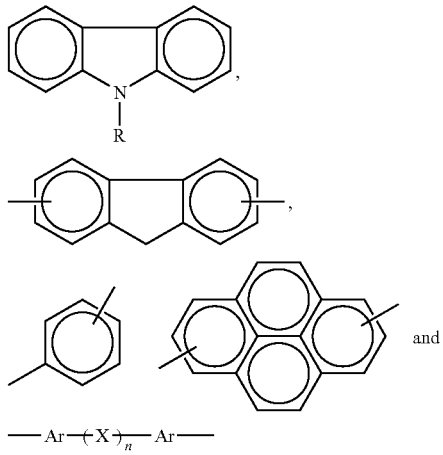

wherein n is 0 or 1; Ar is selected from the group consisting of at least one of

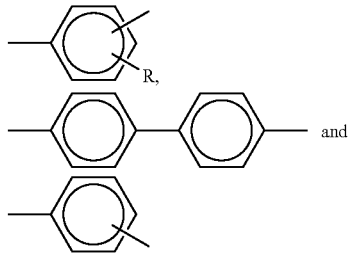

R is selected from the group consisting of at least one of —$CH_3$, —$C_2H_5$, —$C_3H_7$, and $C_4H_9$, and Ar' is selected from the group consisting of at least one of

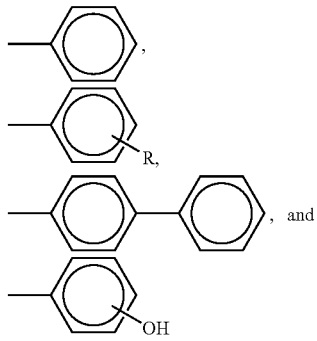

and X is selected from the group consisting of at least one of

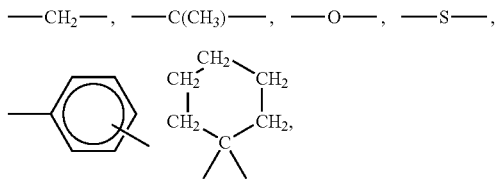

-continued

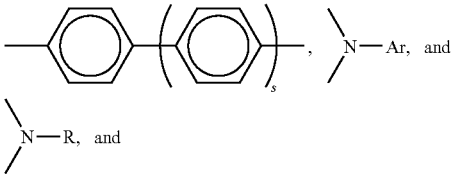

wherein S is zero, 1, or 2.

25. A photoconductor in accordance with claim 1 wherein said overcoat charge transport component is N,NY-diphenyl-N,N'-bis(3-hydroxyphenyl)-[1,1'-biphenyl]-4,4'-diamine.

26. A photoconductor in accordance with claim 1 wherein said overcoat charge transport component is a terphenyl diamine of the following formula

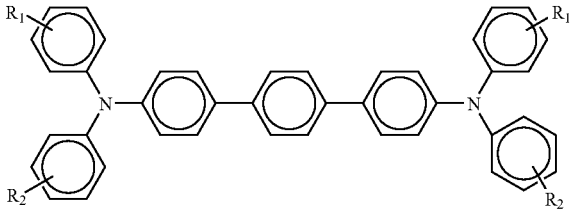

wherein $R_1$ and $R_2$ are independently selected from the group consisting of hydrogen, hydroxyl, alkyl having from 1 to about 12 carbon atoms, arylalkyl having from about 6 to about 36 carbon atoms, and aryl having from about 6 to about 36 carbon atoms groups; and wherein at least one of $R_1$ and $R_2$ is free of hydrogen.

27. A photoconductor in accordance with claim 1 wherein said crosslinking agent is a melamine formaldehyde resin represented by

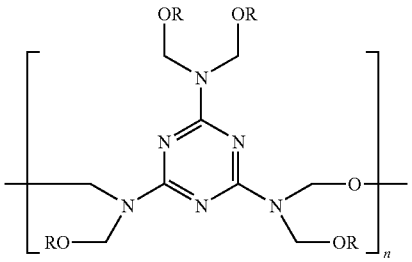

wherein R is selected from the group consisting of hydrogen, methyl, ethyl, propyl, butyl, and mixtures thereof; and n represents the number of repeating units of from about 1 to about100; and said acrylated polyol is represented by $$[R_s—CH_2]_t—[—CH_2—R_a—CH_2]_p—[—CO—R_b—CO—]_n—[—CH_2—R_c—CH_2]_p—[—CO—R_d—CO—]_q$$

wherein $R_s$ represents $CH_2CR_1CO_2$-; wherein t equals 0 to 1, and represents the mole fraction acrylic groups on available sites; wherein $[R_s—CH_2]_t$ can be located in linear or branched portions of $R_a$, $R_b$, $R_c$, and $R_d$; where $R_a$ and $R_c$ independently represent at least one of an alkyl group, an alkoxy group; $R_b$ and $R_d$ independently represent at least one of an alkyl and alkoxy; and m, n, p, and q represent mole fractions, such that n+m+p+q is equal to about 1; and wherein said overcoat primarily contains said acrylated polyol, said polyalkylene glycol, said crosslinking agent, said ketal, and said overcoat charge transport component.

28. A photoconductor in accordance with claim 1 wherein said crosslinking agent is a melamine compound represented by

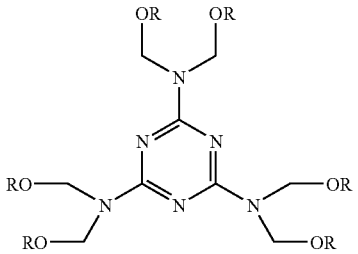

wherein R is selected from the group consisting of at least one of hydrogen, methyl, ethyl, propyl, and butyl.

29. A photoconductor comprised in sequence of an optional supporting substrate, a photogenerating layer; a charge transport layer; and a ketal containing top overcoat layer, and wherein said overcoat ketal is a benzil ketal component present in an amount of from about 0.05 to about 20 weight percent, and wherein said overcoat further includes at least one of a polyol and an acrylated polyol; a polyalkylene glycol, a crosslinking component, and a charge transport component.

30. A photoconductor in accordance with claim 29 wherein said ketal primarily functions to control the light shock characteristics of said photoconductor.

31. A photoconductor comprising a supporting substrate, a photogenerating layer, a hole transport layer, and thereover an overcoat layer, and wherein said overcoat layer has incorporated therein a ketal as represented by or encompassed by

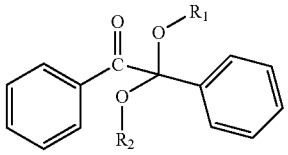

wherein $R_1$ and $R_2$ are each independently at least one of hydrogen, alkyl, and aryl, and wherein said overcoat layer is in contact with and contiguous to said hole transport layer, and which overcoat is comprised of an acrylated polyol, a polyalkylene glycol, a crosslinking component, said ketal, and a charge transport component, and wherein said ketal is present in an amount of from about 0.1 to about 5 weight percent.

32. A photoconductor in accordance with claim 31 wherein said photogenerating layer includes a photogenerating pigment of a metal free phthalocyanine, a metal phthalocyanine, a perylene, or mixtures thereof.

33. A photoconductor in accordance with claim 32 wherein said pigment is at least one of a hydroxygallium phthalocyanine, a halogallium phthalocyanine, a chloroindinium phthalocyanine, a titanyl phthalocyanine, and a bis(benzimidazo) perylene.

34. A photoconductor in accordance with claim 32 wherein said pigment is chlorogallium phthalocyanine Type A, B and C, hydroxygallium phthalocyanine Type V, or titanyl phthalocyanine Type V.

35. A photoconductor comprising a supporting substrate, a photogenerating layer, and at least one charge transport layer comprised of at least one charge transport component, and an overcoat layer in contact with and contiguous to said charge transport layer, and which overcoat is comprised of a crosslinked polymeric network, an overcoat charge transport component, and at least one ketal, and wherein said ketal is alpha, alpha-dimethoxy-alpha-phenylacetophenone present in an amount of from about 0.1 to about 5 weight percent.

* * * * *